US012465120B2

(12) United States Patent
Honda

(10) Patent No.: US 12,465,120 B2
(45) Date of Patent: Nov. 11, 2025

(54) SLIDER FOR A SLIDE FASTENER

(71) Applicant: YKK CORPORATION, Tokyo (JP)

(72) Inventor: Shinya Honda, Ascoli Piceno (IT)

(73) Assignee: YKK CORPORATION, Tokyo (JP)

( * ) Notice: Subject to any disclaimer, the term of this patent is extended or adjusted under 35 U.S.C. 154(b) by 2 days.

(21) Appl. No.: 18/610,194

(22) Filed: Mar. 19, 2024

(65) Prior Publication Data

US 2024/0315402 A1 Sep. 26, 2024

(30) Foreign Application Priority Data

Mar. 24, 2023 (IT) ..... 202023000001215

(51) Int. Cl.
*A44B 19/26* (2006.01)
*A44B 19/30* (2006.01)

(52) U.S. Cl.
CPC ..... *A44B 19/262* (2013.01); *A44B 19/30* (2013.01)

(58) Field of Classification Search
CPC ..... A44B 19/262; A44B 19/30; A44B 19/26; A44B 19/303
See application file for complete search history.

(56) References Cited

U.S. PATENT DOCUMENTS 1,890,336 A 12/1932 Nodine
2,423,210 A * 7/1947 Ulrich ..... A44B 19/308 24/422
2,486,401 A * 11/1949 Gerstman ..... A44B 19/28 24/429
2,495,176 A * 1/1950 Nissen ..... A44B 19/28 24/429
2,736,062 A * 2/1956 Scheuermann. ..... B29D 5/00 249/142
3,006,050 A * 10/1961 Brown ..... A44B 19/306 24/422
3,798,714 A * 3/1974 Mueller ..... A44B 19/303 24/418
4,920,616 A * 5/1990 Takabatake ..... A44B 19/303 24/433
2019/0069645 A1* 3/2019 Shah ..... A44B 19/262

FOREIGN PATENT DOCUMENTS

EP 1527707 5/2005
JP S5210402 1/1977
WO 2015004823 1/2015

* cited by examiner

*Primary Examiner* — David M Upchurch
(74) *Attorney, Agent, or Firm* — JCIPRNET

(57) ABSTRACT

A slider for a slide fastener includes a slider body (11) and two pullers (20, 21) pivotally attached to the slider body (11). The slider body (11) forms an upper wing (12), a lower wing (13), a connecting post (14) connecting the upper and lower wings, and side flanges (15). The side flanges protrude from side edges of the upper and lower wings towards a geometrical mid-plane (P) that lies between the wings (12, 13), so as to form a Y-shaped channel (19) between the upper and lower wings. The upper wing (12) and the lower wing (13) have respective opposite outer surfaces (23, 24) which are substantially flat, and are symmetrical with respect to the geometrical mid-plane (P). At least one locking protrusion (30) protrudes inwardly into the Y-shaped channel (19) from at least one of the side flanges (15) of the slider body (11).

18 Claims, 4 Drawing Sheets

SLIDER FOR A SLIDE FASTENER

CROSS-REFERENCE TO RELATED APPLICATION

This application claims the priority benefits of Italian application no. 202023000001215, filed on Mar. 24, 2023. The entirety of the above-mentioned patent application is hereby incorporated by reference herein and made a part of this specification.

BACKGROUND

Technical Field

The present disclosure relates to a slider for a slide fastener. The slider is intended, particularly but not exclusively, for use with slide fasteners on reversible garments, i.e. garments that can be worn two ways, which differ by turning the garment "inside out".

Description of Related Art

As is known, a slide fastener includes a pair of tapes laid flat, each having an inner edge being the edge of each tape that is closest to an equivalent edge of the other tape. On these respective inner edges, elements are attached in a manner which ensures that when the edges are drawn closer to each other by the action of a slider on the respective elements, these elements are forced to interdigitate with each other. That is, an element from the first tape will be releasably forced into the space between two cooperating contiguous elements on the second tape. Elements are also known as zipper teeth or teeth. Tapes with elements attached in this manner are known as stringers.

A slider consists of an upper wing and a lower wing usually of substantially the same size and positioned so that the upper wing covers the entirety of the lower wing with a connecting post at the front and centre of each of the wings, holding them together. At the edges of the upper wing on the direction of travel of the slider pointing downwards and at the edges of the lower wing on the direction of travel of the slider pointing upwards are flanges also known as guide rails. The combination of the guide rails creates a mouth at the tail end of the slider opposite to the head end where the connecting post is fixed as well as two mouths at the head end each formed between the connecting post and respective flanges. The mouths are the entry and exit points of a Y shaped space within the slider, which provide channels for the elements at the edge of each of the tapes. When the slider is drawn along the elements in a headward or front direction, the elements are forced to interdigitate and so attach to each other whereas when the slider moves in a tailward or back direction the elements open.

In order to help the slider move, commonly there is a mechanism on the upper surface of the upper wing of the slider. The upper wing provides a bridge to which a puller (or pull-tab) is attached to allow the slider to be moved in either direction.

When a slide fastener is to be opened/closed, the user normally takes hold of the pull-tab (or the slider body) and pulls the slider forward or backwards, that is headward or tailward. This will close or open the slide fastener, depending on the direction of travel of the slider. When the slide fastener is held upright (vertically), a slider may, under the effects of gravity, tend to move down the elements of the slide fastener and so open in an unintended manner. For this reason, sliders have been developed with a locking device that automatically locks the slider in position on the slide fastener. The locking mechanism includes a locking pawl which may pass through a hole in the upper wing of the slider. The locking pawl is capable of resting in the gap between two consecutive elements on one stringer to ensure that, if the slider is urged to move in a downward direction, the locking pawl resists and keeps the slider in place along the slide fastener. The locking action provided by the pawl must be removed when it is necessary to move the slider in a downward direction. To this end, a mechanism to ensure that the locking pawl moves out of the path of the teeth has also been developed. By lifting the puller up, the locking pawl is disengaged from the elements of the stringer.

The present disclosure is related to a zipper slider, which has substantially flat wings on both sides and also has two pullers.

Reversible sliders are known having two pullers and spring locks. An example is given by patent publication EP 1527707 A1, that discloses a zipper slider having two pullers and lock system for reversible use. The slider includes several internal parts that cause the slider to be bulky and disadvantageous in terms of manufacturing costs.

In order to prevent a slider from being moved rearwardly and thus from disengaging the fastener, JP U 119770 10402 (Japanese Unexamined Utility Model Application published under No. S52-10402U) discloses locking protrusions protruding inwardly from the side flanges of the slider into the path of the elements of a stringer. As the slider tends to go down, opening the slide fastener, locking protrusions engage a gap between two consecutive elements of a stringer, thereby locking the slider in position along the slide fastener.

U.S. Pat. No. 1,890,336 discloses toothlike prong members which are inwardly bent to project a short distance from side flanges at right angles thereto into the path of an adjacent guideway and in the direction of the opposite flange of the slider in order that each prong may be readily receivable between the individual elements of each stringer.

Patent publication WO 2015/004823 A1 discloses a flat slider with one puller without locking protrusions or any other locking system.

SUMMARY

It is an object of the present disclosure to provide a reversible slider which can be manipulated from either side and having opposite wings or plates with substantially symmetrical and flat surfaces that may avoid damaging the user wearing the garment on which the slide fastener is fixed. Another purpose of the disclosure is to provide a reversible slider capable of having pleasant aesthetic features.

The above and other objects and advantages are accomplished, according to an aspect of the disclosure, by a slider as defined as following.

In brief, a slider for a reversible slide fastener is disclosed, the slider including:

- a slider body forming an upper wing, a lower wing, a connecting post connecting the upper and lower wings, side flanges protruding from side edges of the upper wing and side edges of the lower wing towards a geometrical mid-plane that lies between the wings, so as to form a Y-shaped channel between the upper and lower wings, wherein the upper wing and the lower wing have respective opposite outer surfaces which are substantially flat, and are symmetrical with respect to said geometrical mid-plane;

two pullers pivotally attached to the slider body;

at least one locking protrusion protruding inwardly into the Y-shaped channel from at least one of the side flanges of the slider body.

BRIEF DESCRIPTION OF THE DRAWINGS

Further objects, features, aspects and advantages of the present disclosure will become apparent from the following description, provided purely by way of non-limiting examples. Reference is made to the accompanying drawings, in which.

DESCRIPTION OF THE EMBODIMENTS

Figure 1:
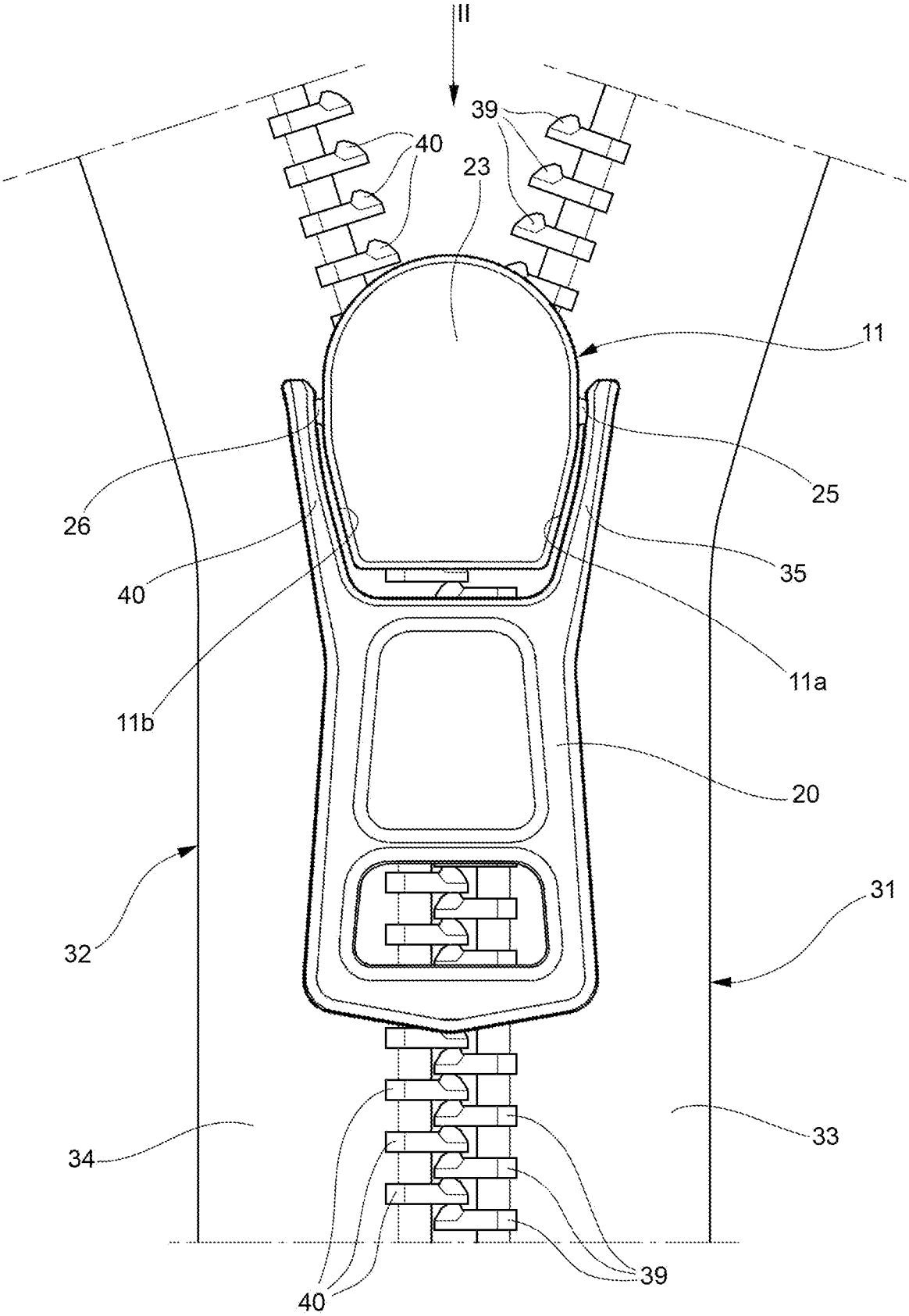
FIG. 1 is a top view of a slide fastener equipped with a slider according to an embodiment of this disclosure.
Figure 2:
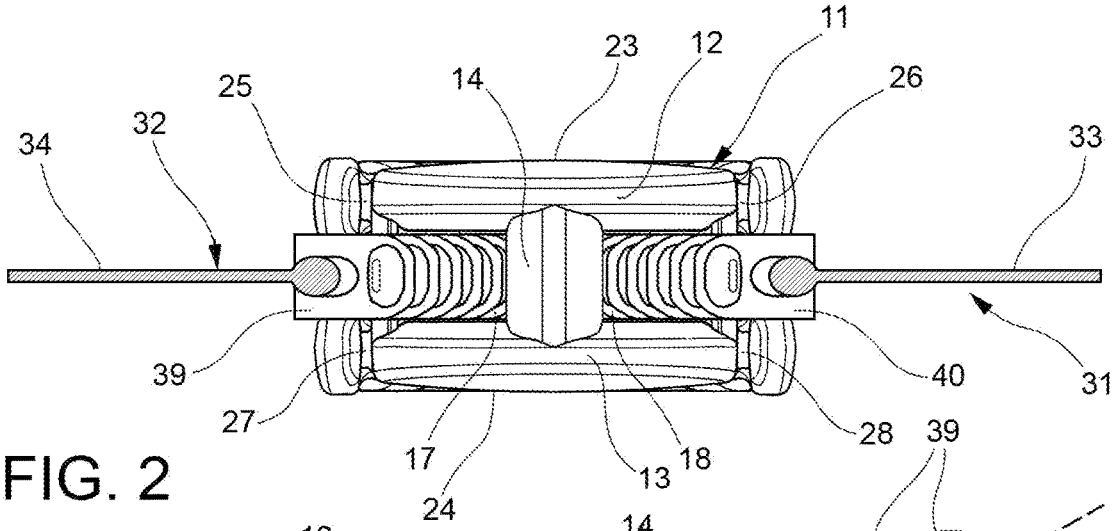
FIG. 2 is a view of the slide fastener according to arrow II in FIG. 1.

Referring to the drawings, a slider 10 for a reversible slide fastener comprises a slider body 11 and two pull-tabs or pullers 20, 21 pivotally attached to the slider body 11. The slider body and the pull-tabs may be of metal, for example manufactured by die-casting moulding. The pullers may be formed by pressing a metal.

In the following explanations, the term "longitudinal" designates the direction of movement of the slider along a slide fastener. A direction that is across the front and rear surfaces of the fastener tapes and perpendicular to the longitudinal direction is defined as the "transversal" direction or the "width" direction. Terms such as "front", "forward" or "headward" and "back" "tailward" or "rear" refer to the direction in which a slider is relatively moved with respect to the rows of the fastener elements in order to engage and disengage the rows of the fastener elements. When the slider is drawn along the elements in a "front" "forward" or "headward" direction, the elements are forced to interdigitate and so attach to each other, whereas when the slider moves in a backward, tailward or rear direction, the elements open. The direction that is perpendicular to the longitudinal and transversal directions is defined as the "vertical" direction or the "height" direction. Terms such as "upper" and "lower" refer to the vertical direction.

The slide fastener, to which the slider may be applied, typically includes a pair of first and second fastener stringers 31, 32, or right (31) and left (32) fastener stringers (as viewed in FIG. 1), each having a ribbon or band-like fastener tape 33, 34. The fastener tapes 33, 34 each have inner side facing edges. An element row 39, 40 is attached to each tape inner side edge. Each element row is formed by a plurality of fastener elements, which are attached to a respective one of the tape inner side edge portions. The fastener elements may be conventional. For example, the fastener elements may be made of metal or plastics and may be discrete or continuous. For example, the fastener elements may comprise elements made from metal or injection moulded plastic or be joined in a row of continuous coil. The slider 10 is slidably arranged along the element rows 39, 40.

The slider body 11 forms an upper wing (or upper plate) 12 and a lower wing 13 (or lower plate), having respective opposite outer surfaces 23, 24 which preferably have the same size and shape, and are symmetrical with respect to a geometrical mid-plane P that lies between the upper wing and the lower wings and is perpendicular to the vertical direction. Due to this arrangement, each wing covers the entirety of the other wing, when viewed in the vertical direction. The slider body 11 (FIG. 1) defines a front side or head end, a rear side or tail end, a right side 11*a* and a left side 11*b*.

The slider body 11 forms a connecting post 14 at the front extending towards the centre of each of the wings, joining and holding them together. At the edges of the upper wing on the direction of travel of the slider protruding downwards in the height direction and at the edges of the lower wing on the direction of travel of the slider protruding upwards in the height direction are side flanges or guide rails 15. The combination of the upper wing 12 and the lower wing 13 and side flanges 15 creates a Y-shaped channel 19 between the upper and lower wings, configured to receive the elements at the edge of each of the tapes. The Y-shaped channel 19 has a single mouth 16 at the tail end of the slider opposite to the head end where the connecting post 14 is fixed as well as two right and left mouths 17, 18 at the head end, each formed between the connecting post 14, the upper wing 12 and the lower wing 13 and respective side flanges 15.

The outer surfaces 23, 24 of the wings 12, 13 are preferably flat, or substantially flat, or slightly convex or concave. The opposite outer surfaces 23, 24 may be parallel or substantially parallel to each other. Noticeably, the wings do not have conventional puller attachment portions protruding vertically from the outer surfaces 23, 24. The flat or substantially flat outer surfaces 23, 24 are not uncomfortable for the user in case the slider might come in contact with the user's body.

Each wing 12, 13 forms a respective pair of transversally protruding opposite puller attachment portions 25, 26 and 27, 28. A first pair of puller attachment portions 25, 26 provide pivotal connections for a first one (20) of the two puller tabs

20, 21; a second pair of puller attachment portions 27, 28 provide pivotal connections for the second one (21) of the two puller tabs 20, 21.

The puller attachment portions may be shaped as pins, each pin protruding transversally outwardly from one side of one of the wings.

The disposition of the puller attachment portions on the opposite sides of the slider body allows to give the outer surfaces 23, 24 of the wings 12, 13 a flat, or substantially flat shape.

According to a preferred embodiment, the first pair of puller attachment portions 25, 26 are arranged symmetrically to the second pair of puller attachment portions 27, 28 with respect to the mid-plane P.

In order to pull the slider properly, the two puller attachment portions within each pair of puller attachment portions 25, 26 and 27, 28 are preferably aligned along a respective transversal pivotal axis.

Further, according to a preferred embodiment, the puller attachment portions 25-28 are each located substantially at an equal distance from the front end and the back end of the slider body 11.

Each puller 20, 21 forms a respective pair of right and left legs 35, 36 and 37, 38. The puller attachment portions 25-28 each provide a point for pivotally connecting a respective leg 35-38 of the two pullers 20, 21. Each one of the right and left legs 35-38 of the pullers 20, 21 has a respective end portion pivotally mounted to a respective one of the puller attachment portions 25-28, whereby each puller is pivotally mounted to the slider body 11 about a respective transversal pivotal axis.

Figure 7:
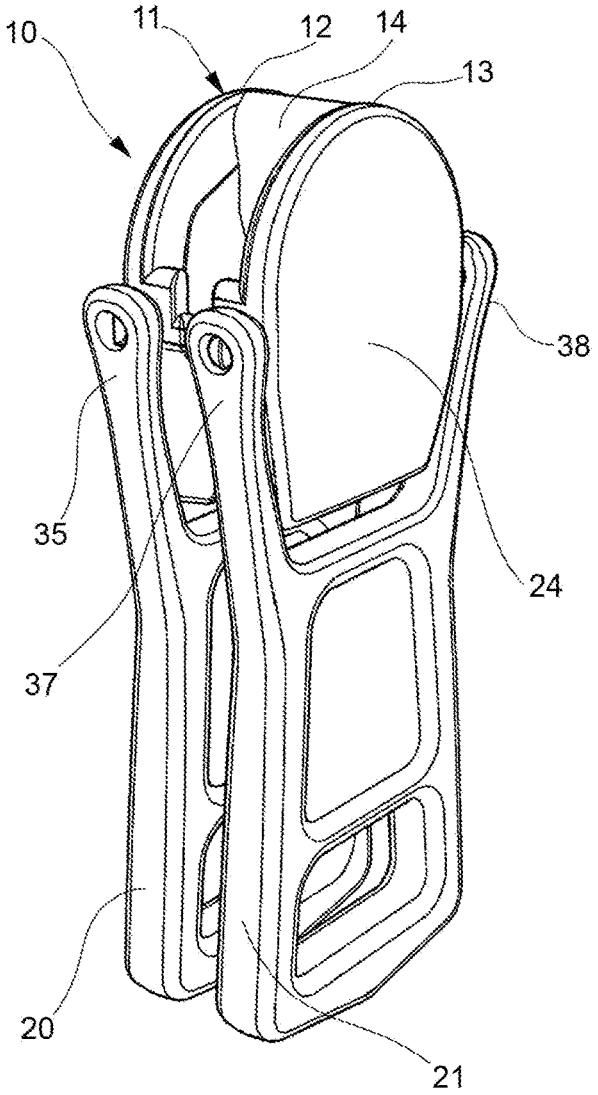
FIG. 7 is a perspective view of the slider of FIG. 1.
Figure 8:
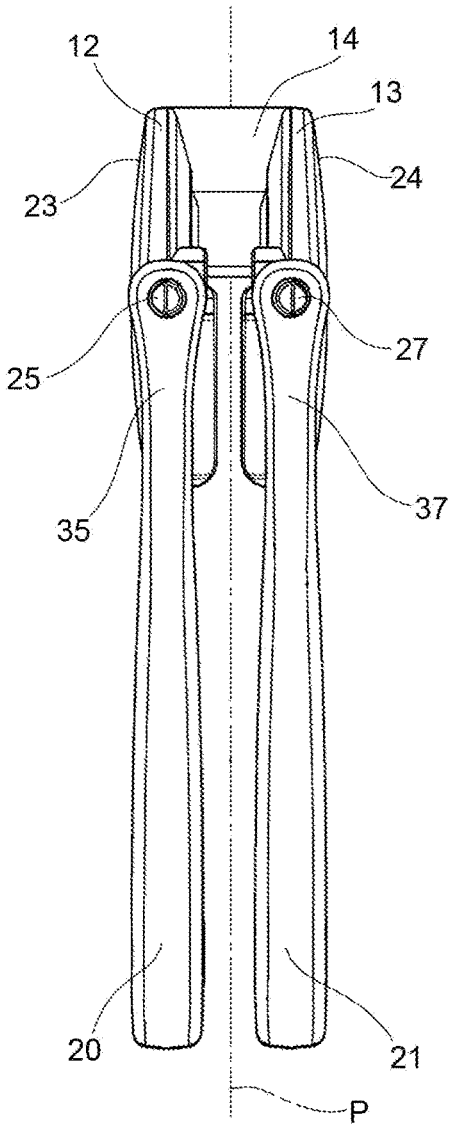
FIG. 8 is a side elevational view of the slider of FIG. 7.
Figure 9:
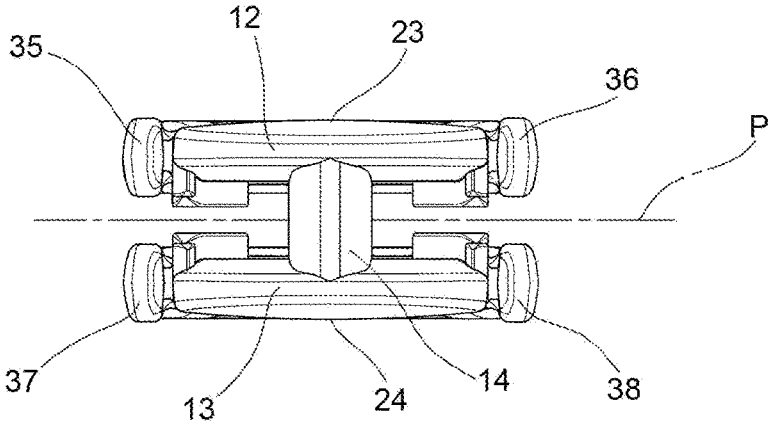
FIG. 9 is a front view of the slider of Figure

Advantageously, as shown in FIG. 1, legs 35 and 36 (37 and 38) are longer than the distance from the puller attachment portions 25-28 to the tail end of the slider body 11, so that the pullers 20, 21 can be turned and laid to be flush with the outer surfaces 23, 24 of the slider body 11 (FIGS. 7, 8). This arrangement allows the slider body 11 and the pullers 20, 21 to take a flattened shape.

Figure 5:
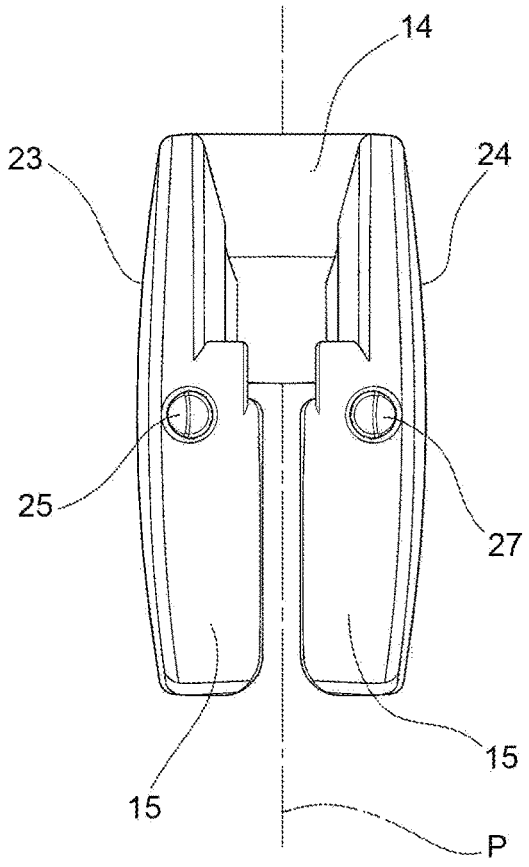
FIG. 5 is a side elevational view of the slider body of FIG. 4.
Figure 6:
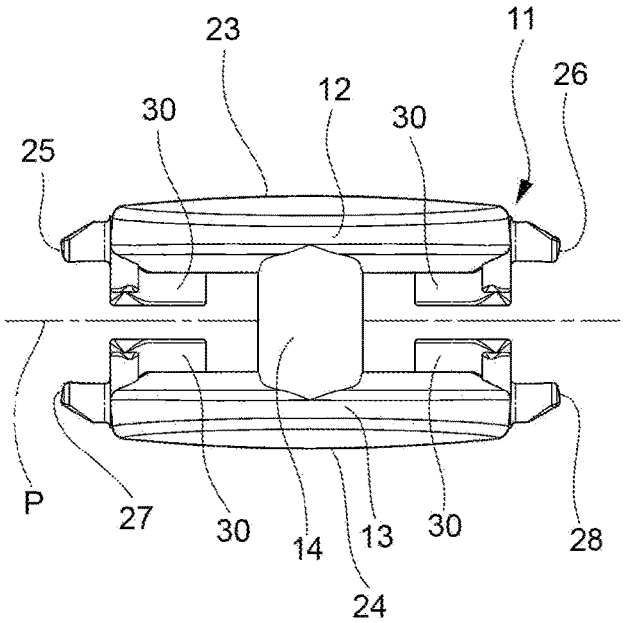
FIG. 6 is a front view of the slider body of FIG. 4.

Preferably, as shown particularly in FIGS. 5 and 6, in order to achieve the flattened shape, the puller attachment portions 25-28 are disposed on the sides of the wings so as not to protrude beyond the outer surfaces 23, 24 of the wings 12, 13.

With the present slider, when applied to a reversible garment, one of the two pullers 20, 21 is accessible to the user from one side of the slide fastener, while the other puller is accessible from the other (back or reverse) side of the slide fastener.

Advantageously, the flat or substantially flat outer surfaces 23, 24 allow to bear engraved designs or decorative covers or other aesthetically valuable items. This advantage is achieved by locating the puller-attachment portions 25-28 on the sides of each wing and not on the outer surfaces of the wings, that are therefore available for bearing decorations.

The symmetrical shape of the slider is advantageous in that it simplifies the manufacturing process, where it is conventionally required to distinguish the front from the back of the slider body to handle it and assemble the slider.

In order to lock the slider and prevent it from moving down inadvertently, further the slider body forms at least one locking protrusion 30 protruding inwardly from at least one of the side flanges of the slider into the Y-shaped channel 19, and particularly into at least one of the two paths for the elements of at least one of the stringers. As the slider tends to go down, opening the slide fastener, the locking protrusion 30 engages a gap between two consecutive elements of a stringer, thereby locking the slider in position along the slide fastener.

According to a preferred embodiment, the locking protrusion 30 is formed to project inwardly a short distance from one side flange into at least one of the mouths 17, 18 at the head end of the slider body.

Preferably, the locking protrusion 30 is formed having a vertical height which is shorter than the vertical height of the side flange from which the locking protrusion protrudes.

According to a preferred design, the locking protrusion 30 extends forming an obtuse angle with the side flange from which it protrudes.

Further, according to a preferred design, the locking protrusion 30 extends in a direction that is parallel to a side edge of the wing that is close to the locking protrusion.

Figure 3:
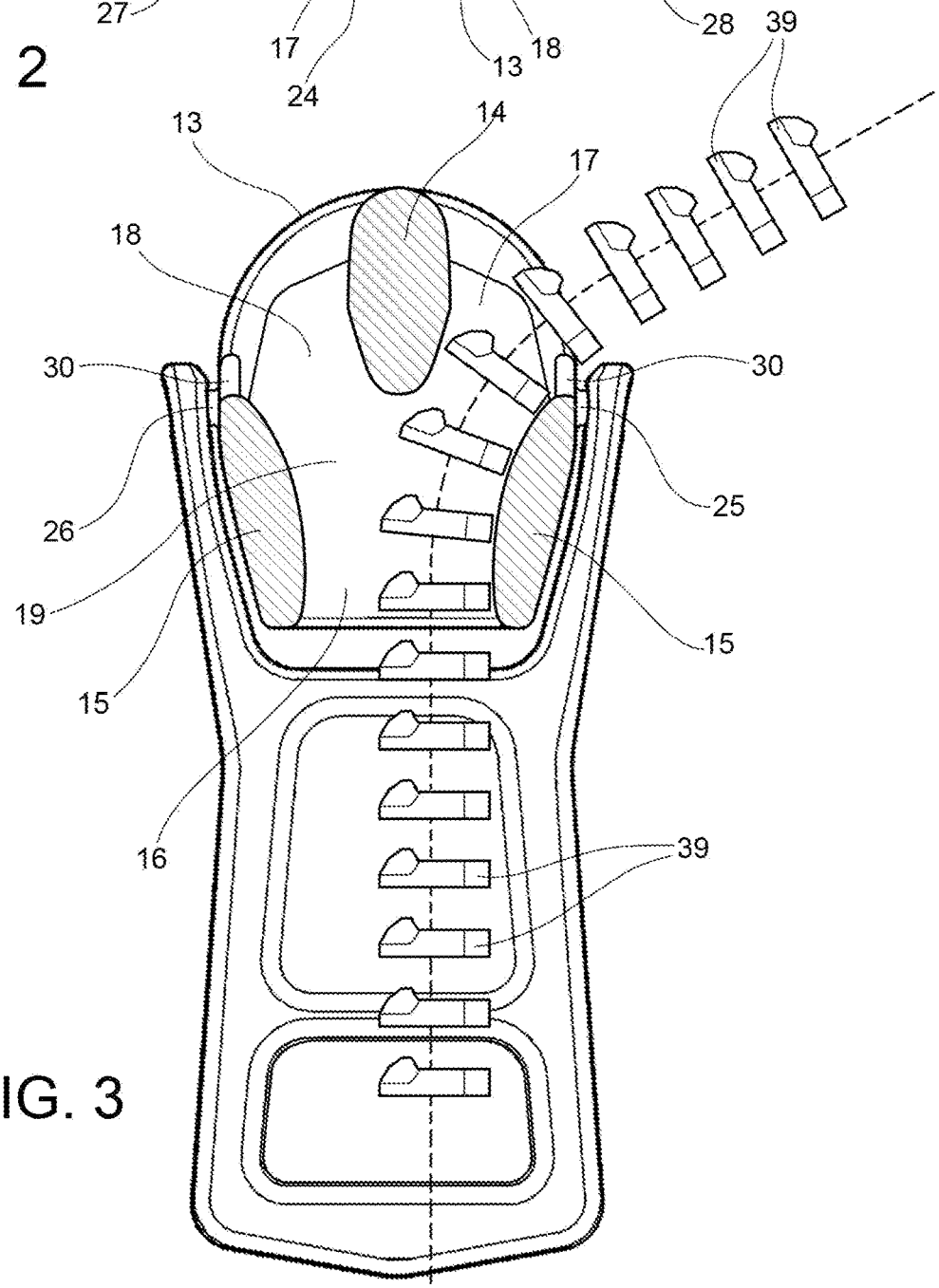
FIG. 3 is a schematic top view showing part of the slider of FIG. 1 and a row of fastener elements.
Figure 4:
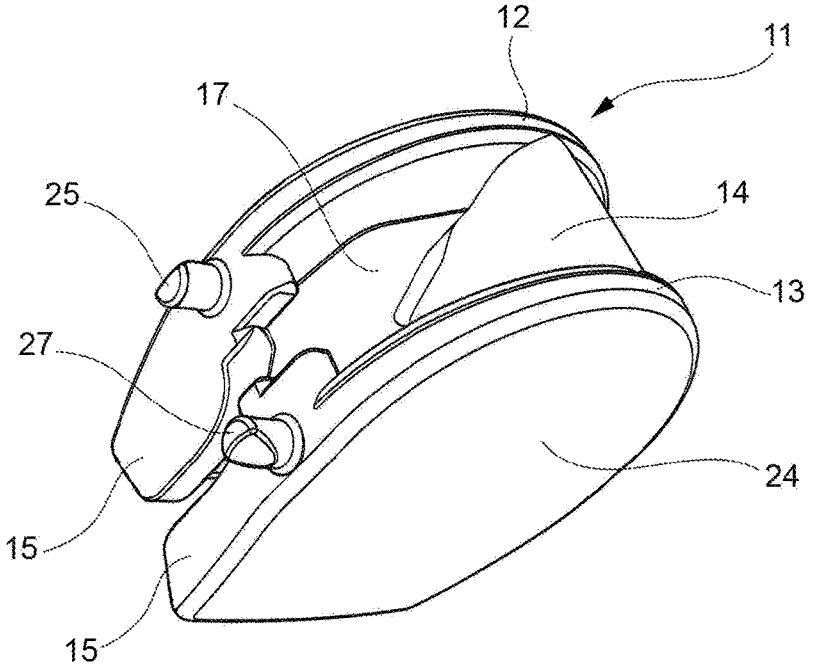
FIG. 4 is a perspective view of the slider body of the slider of FIG. 1.

Embodiments may provide that, as shown in the drawings, at least two locking protrusions 30 are provided by the slider body, each locking protrusion protruding inwardly into a respective one of the two paths for the elements of at least one of the stringers. According to an embodiment, as shown in FIG. 3, the two locking protrusions 30 may be formed by a same one of the two wings 12, 13.

According to an alternative embodiment (not shown in the drawings), a first locking protrusion may be formed by the upper wing, protruding into a first one of the two paths for one row of elements, and a second locking protrusion may be formed by the lower wing, protruding into the second one of the two paths for the other row of elements.

According to the embodiment shown in the drawings, four locking protrusions 30 may be provided: a first pair of locking protrusions 30 may be formed by the upper wing, respectively protruding into the first and the second paths for the two rows of elements, and a second pair of locking protrusions 30 may be formed by the lower wing, respectively protruding into the first and second paths for the two rows of elements.

The locking protrusions 30 are preferably arranged adjacent to the puller attachment portions. This arrangement of the locking protrusions provides the advantage of reinforcing the side regions of the slider body which resist force from puller's movement through the puller attachment portions.

A number of aspects and embodiments of the slider have been described. It is to be understood that each aspect and embodiment may be combined with any other aspect or embodiment. Moreover, the disclosure is not restricted to the described embodiments, but may be varied within the scope of the accompanying claims and their legal equivalents.

What is claimed is:

1. A slider for a slide fastener, the slider comprising:

a slider body (11) forming an upper wing (12), a lower wing (13), a connecting post (14) connecting the upper and lower wings, side flanges (15) protruding from side edges of the upper wing and side edges of the lower wing towards a geometrical mid-plane (P) that lies between the wings (12, 13), so as to form a Y-shaped channel (19) between the upper and lower wings, wherein the upper wing (12) and the lower wing (13) have respective opposite outer surfaces (23, 24) and are symmetrical with respect to said geometrical mid-plane (P);

two pullers (20, 21) pivotally attached to the slider body (11);

at least one locking protrusion (30) protruding inwardly into the Y-shaped channel (19) from at least one of the side flanges (15) of the slider body (11).

2. The slider according to claim 1, wherein the outer surfaces (23, 24) of the wings (12, 13) are flat.

3. The slider according to claim 1, wherein the outer surfaces (23, 24) of the wings (12, 13) are parallel to each other.

4. The slider according to claim 1, wherein each wing (12, 13) forms a respective pair of transversally protruding opposite puller attachment portions (25, 26; 27, 28) for pivotally mounting each puller (20, 21) to the slider body (11) about a respective transversal pivotal axis.

5. The slider according to claim 4, wherein the puller attachment portions (25, 26; 27, 28) are shaped as pins, wherein each pin protrudes transversally outwardly from one side of one of the wings.

6. The slider according to claim 4, wherein the two pairs of puller attachment portions (25-28) are arranged symmetrically with respect to said geometrical mid-plane (P).

7. The slider according to claim 4, wherein each puller (20, 21) forms a respective pair of right and left legs (35, 36; 37, 38), each of which have a respective end portion pivotally mounted to a respective one of said puller attachment portions (25, 26; 27, 28), and wherein said legs (35, 36; 37, 38) each are longer than a distance from the puller attachment portions (25, 26; 27, 28) to a tail end of the slider body (11), whereby the pullers (20, 21) can be turned and laid to be flush with a respective one of the outer surfaces (23, 24) of the slider body (11), thereby allowing the slider body and the pullers to take a flattened shape.

8. The slider according to claim 4, wherein the puller attachment portions (25-28) are each located at equal distances from a front end and a back end of the slider body (11).

9. The slider according to claim 4, wherein the Y-shaped channel (19) has a single mouth (16) at a tail end of the slider opposite to a head end where the connecting post (14) is arranged, and two mouths (17, 18) at the head end, each formed between the connecting post (14), the upper wing (12) and the lower wing (13) and the respective side flanges (15), wherein said at least one locking protrusion (30) projects inwardly from one side flange (15) into at least one of the mouths (17, 18) at the head end of the slider body (11).

10. The slider according to claim 9, wherein at least two locking protrusions (30) are provided by the slider body, each locking protrusion protruding inwardly into a respective one of the two mouths (17, 18) at the head end of the slider body (11).

11. The slider according to claim 10, wherein the at least two locking protrusions (30) are formed by a same one of at least one of the two wings (12, 13).

12. The slider according to claim 10, wherein two pairs of locking protrusions (30) are provided, of which a first pair of locking protrusions is formed by the upper wing (12), each locking protrusion protruding inwardly into a respective one of the two mouths (17, 18) at the head end of the slider body (11), a second pair of locking protrusions is formed by the lower wing (13), each locking protrusion protruding inwardly into a respective one of the two mouths (17, 18) at the head end of the slider body (11).

13. The slider according to claim 10, wherein said at least one locking protrusion (30) has a vertical height which is shorter than a vertical height of the side flange from which the at least one locking protrusion protrudes.

14. The slider according to claim 10, wherein said at least one locking protrusion (30) extends forming an obtuse angle with the side flange (15) from which the at least one locking protrusion protrudes.

15. The slider according to claim 10, wherein said at least one locking protrusion (30) extends in a direction that is parallel to a side edge of a wing of the wings that is close to the at least one locking protrusion.

16. The slider according to claim 12, wherein the at least two locking protrusions (30) are arranged adjacent to the puller attachment portions (25-28).

17. The slider according to claim 1, wherein the outer surfaces (23, 24) of the wings (12, 13) are convex.

18. The slider according to claim 1, wherein the outer surfaces (23, 24) of the wings (12, 13) are concave.

* * * * *